US005732619A

United States Patent [19]

Hata et al.

[11] Patent Number: 5,732,619

[45] Date of Patent: Mar. 31, 1998

[54] PRESS MACHINE WITH PRESS FUNCTION DISPLAY

[75] Inventors: Yukio Hata; Iwashige Takahashi; Hitoshi Sakurai; Satoshi Awatani, all of Ishikawa, Japan

[73] Assignee: Komatsu Ltd., Tokyo, Japan

[21] Appl. No.: 727,588

[22] PCT Filed: Apr. 24, 1995

[86] PCT No.: PCT/JP95/00804

§ 371 Date: Oct. 28, 1996

§ 102(e) Date: Oct. 28, 1996

[87] PCT Pub. No.: WO95/29809

PCT Pub. Date: Nov. 9, 1995

[30] Foreign Application Priority Data

Apr. 28, 1994 [JP] Japan ..... 6/111809

[51] Int. Cl.[6] ..... B30B 15/14

[52] U.S. Cl. ..... 100/53; 100/99

[58] Field of Search ..... 100/43, 48–53, 100/99, 282

[56] References Cited

U.S. PATENT DOCUMENTS

| | | | |
|---|---|---|---|
| 4,446,787 | 5/1984 | Nishikawa et al. | 100/99 |
| 5,129,317 | 7/1992 | Gloe et al. | 100/48 |
| 5,379,688 | 1/1995 | Ishii | 100/99 |

FOREIGN PATENT DOCUMENTS

| | | | |
|---|---|---|---|
| 59-107800 | 6/1984 | Japan | 100/99 |
| 60-37300 | 2/1985 | Japan | 100/53 |
| 1-304503 | 12/1989 | Japan . | |
| 2-42796 | 3/1990 | Japan . | |
| 2-104197 | 8/1990 | Japan . | |
| 2-241698 | 9/1990 | Japan | 100/99 |
| 2-284799 | 11/1990 | Japan | 100/99 |
| 2-290699 | 11/1990 | Japan . | |
| 2-144296 | 12/1990 | Japan . | |
| 3-68996 | 7/1991 | Japan . | |
| 4-322899 | 11/1992 | Japan | 100/43 |
| 5-57500 | 3/1993 | Japan . | |
| 6-5799 | 1/1994 | Japan . | |
| 6-71498 | 3/1994 | Japan . | |

*Primary Examiner*—Stephen F. Gerrity
*Attorney, Agent, or Firm*—Sidley & Austin

[57] ABSTRACT

A press machine, whose set operating conditions, pressing state, etc., can be easily grasped and whose safety and operability in the pressing operation can be improved, has a console panel (26) provided with a crank angle display (70), a pressing state display (80), a sheet switch (106) for inputting control information into a control section, and a multi-display (102) capable of displaying a plurality of pieces of the control information at a time. The crank angle display (70) can be constituted of multiple light emitting sections (72) arranged into a circle, and successive ones (72*a*) of the light emitting sections (72) whose number corresponds to the crank angle can be turned on.

14 Claims, 8 Drawing Sheets

FIG. 7A

CONTINUOUS MODE INPUT ABNORMALITY

1. TOTAL COUNTER 1 ON 1 2 3 4 5 6 7
2. LOT COUNTER 1 ON 1 2 3 4 5 6 SETTING 200000
3. TOTAL COUNTER 2 OFF 0
4. LOT COUNTER 2 OFF 0 SETTING 0

| PRODUCTION II | PRODUCTION | PREPARATORY PLANNING | SETTING | I L |
|---|---|---|---|---|

FIG. 7B

MODE INPUT ABNORMALITY

RUN KEY INPUT ABNORMALITY

STANDBY POINT SELECTION ABNORMALITY

RELEASE EXTERNAL SUDDEN STOP FACTOR

ACTUATE MAIN MOTOR FORWARD

RETURN TO STANDBY POINT BY INCHING

| 2 | PRODUCTION | PREPARATORY PLANNING | SETTING | RETURN |
|---|---|---|---|---|

FIG. 8A

SYSTEM SETTING SELECTION

1 SPECIFICATION CIRCUIT INITIALIZATION

2 CLUTCH BRAKE CONTROL SYSTEM CONSTANT

3 CLUTCH BRAKE STANDBY POINT STOP ADJUSTMENT

4 MAINTENANCE

| | PRODUCTION | PREPARATORY PLANNING | SETTING | |
|---|---|---|---|---|

FIG. 8B

SPECIFICATION CIRCUIT INITIALIZATION 1 (STANDARD)

| | | | |
|---|---|---|---|
| 1 | C/B AIR PRESSURE | 6 | EMERGENT STOP |
| 2 | SLIDE ADJUSTMENT | 7 | ABNORMALITY-INTERLOCK |
| 3 | MAIN M CIRCUIT | 8 | TOTAL COUNTER 1 |
| 4 | OVERLOAD | 9 | LOT COUNTER 1 |
| 5 | GREASE SUPPLY FOR LUBRICATION | 10 | EJECTOR 1 |

| 2 | PRODUCTION | PREPARATORY PLANNING | SETTING | RETURN |
|---|---|---|---|---|

FIG. 8C

SPECIFICATION CIRCUIT INITIALIZATION 2 (OPTION)

| | | | |
|---|---|---|---|
| 11 | STAR-DELTA START-UP | 16 | ERROR FIELD DETECTION |
| 12 | FLYWHEEL BRAKE | 17 | GIB INTERMITTENT GREASE SUPPLY |
| 13 | MOTOR-POWERED LUBRICATION | 18 | GIB OIL AMOUNT CHECK |
| 14 | BALANCER AIR PRESSURE | 19 | SLIDE ADJUSTMENT LOCK |
| 15 | MAIN M FORWARD/ BACKWARD SELECTOR | 20 | HIGH TORQUE |

| 3 | PRODUCTION | PREPARATORY PLANNING | SETTING | RETURN |
|---|---|---|---|---|

PRESS MACHINE WITH PRESS FUNCTION DISPLAY

TECHNICAL FIELD

The present invention relates to a press machine, and more particularly to an operating section attached to the side face of a press body.

BACKGROUND ART

A press machine, heretofore in use, has a press operating section in which a control button for manually operating a slide, an emergency stop button, etc., are disposed, and which is attached to the front face of a machine body, and an operating section attached to the side face of the machine body in a position easily viewable by a press operator. In the latter operating section, there are disposed control switches making up a run mode setting section for selecting a run mode of the press machine between automatic operation and manual operation, a main motor start-up switch, a speed setting section for setting the pressing speed, etc., so that the operator can easily make various settings, with a view of ensuring safety and improving operability.

In such a press machine, however, when confirming the run mode (operation mode) prior to the start of pressing, the operator is required to visually check both the position of the operation mode selecting switch and the name plate corresponding to the position of the selecting switch in the press operating section attached to the front face of the machine body or the operating section attached to the side face of the machine body. Therefore, the operator may select the wrong operation mode by mistake. In addition, for example, if the press operation mode selecting switch suffers a contact failure, the correct operation mode is not set even with the operator correctly selecting the operation mode. This may result in a risk that a serious trouble possibly occurs. Further, with conventional press machines, it has been difficult for the operator to judge press operating conditions, etc., at a glance.

As another example of the prior art, Japanese Utility Model Unexamined Publication No. 6-5799 discloses a remote control press machine, wherein a portable console panel is separately provided from a press machine body, and a beam of light or electric wave is transmitted from the console panel to a control box provided on the press machine body, enabling setting conditions, etc., to be instructed from a remote position.

However, because such a portable console panel is disconnected from the press machine and operates in a non-contact manner, it is given directivity and, when used, must be directed toward the control box provided on the press machine body. This has raised a concern that, depending on the position of the operator, the press machine may not be operated or may be erroneously operated. Also, because the portable console panel is disconnected from the press machine, it has been susceptible to damage by being dropped onto the floor or trodden under foot, or being missing.

SUMMARY OF THE INVENTION

The present invention has been accomplished with a view of solving the above-mentioned disadvantages in the prior art, and an object is to provide a press machine which can improve safety and operability in the pressing operation. Another object of the present invention is to enable press operating conditions, etc., to be easily grasped. Still another object of the present invention is to provide a press machine having a remote console panel which is free from operating errors and can be handled with less care.

A first aspect of the press machine according to the present invention is featured in that the press machine has a console panel provided with crank angle displaying means, for displaying the rotational position of a drive shaft detected by rotation detecting means; pressing state displaying means, for displaying a press operating state; sheet switch means, for inputting control information, such as the vertically moving speed of a slide, the number of pressed products, the production lot, and press operating conditions, into a control section; and multi-displaying means capable of displaying a plurality of pieces of the control information inputted from the sheet switch means at a time. The crank angle displaying means can be constructed to be able to display, in a switchable manner, one of the vertically moving speed of the slide, determined by the control section based on an output of the rotation detecting means, and the crank angle indicating the rotational position of the drive shaft. A press operating section can be disposed on the front face of a press body, and the run mode selected by a selection switch on the press operating section can be displayed on the multi-displaying means.

With the above construction, since the press operating state is displayed on the pressing state displaying means and control information such as operating conditions is displayed on the multi-displaying means, the operator can easily confirm the operating state such as whether or not the press machine is operating normally, and the operating conditions such as the run mode. Accordingly, safety and operability in the pressing operation can be improved. In this connection, when the crank angle displaying means is constructed to be able to selectively display the vertically moving speed of the slide, the operator can easily confirm whether or not the pressing speed is equal to the set value. Also, when the multi-displaying means is constructed to be able to display the run mode selected by the selection switch, the operator can not only easily detect the occurrence of an abnormality such as a contact failure of the selection switch, but also surely visually confirm the selected run mode with ease, resulting in improved safety and operability in the pressing operation.

Next, a second aspect of the press machine is featured in that the press machine includes a crank angle displaying means for displaying the rotational position of a drive shaft detected by crank angle detecting means; the crank angle displaying means is constituted of multiple light emitting sections arranged into a circle; and successive ones of the light emitting sections are turned on whose number corresponds to the crank angle detected by the crank angle detecting means. The turning-on of successive ones of the light emitting sections is made in different directions depending on whether the drive shaft is rotated forwardly or backwardly.

With the above construction, the operator can easily discern whether the slide is in down stroke or in up stroke. Also, from the display indicating whether the drive shaft is rotating forwardly or backwardly, the operator can easily recognize the rotating direction of the drive shaft.

Next, a third aspect of the press machine is featured in that the press machine includes pressing state displaying means for displaying a press operating state; the pressing state displaying means comprising, at least, a run preparation state displaying section, for displaying a press preparation state in the form of a figure; and a state-of-safety-confirming-means displaying section, for displaying an operating state of the safety confirming means in the form of a figure. The run preparation state displaying section and the state-of-safety-confirming-means displaying section display the respective states in different colors which are changed depending on the press preparation state and the operating state of the safety confirming means. Multi-displaying means can be disposed near the pressing state displaying means, and the multi-displaying means can display at least one of the state corresponding to the display color and the contents of actions to be taken by an operator corresponding to the state represented by the display color.

With the above construction, since the preparation state, indicating whether or not predetermined pieces of control information for the press machine have been completely set, is displayed on the pressing state displaying means in the form of a figure, the operator can easily judge at a glance whether or not the press machine is in a run enabled state. Further, since the state-of-safety-confirming-means displaying section, for displaying in the form of a figure whether or not the safety confirming means is effectively operating, is disposed in the pressing state displaying means, the operator can confirm the safety state of the press machine at a glance and perform the pressing operation free from anxiety, while a possible risk is surely prevented. In addition, by displaying, in different colors, the progress of the preparation state and the safety state such as represented by whether or not the safety confirming means is operating normally, both operability and safety can be further improved. Also, by displaying the state corresponding to the display color and the contents of actions to be taken by the operator, the operator can easily recognize in what stage the preparation is, what obstacle exits in the course of preparation, what action is to be taken to eliminate the obstacle, etc. This also contributes to an improvement in operability.

Next, a fourth aspect of the press machine is featured in that the press machine includes multi-displaying means, for displaying a screen image for specification setting which is made up of control information inputted to a control section, such as the vertically moving speed of a slide, the number of pressed products, the production lot, and the run mode; and input means for adding, cancelling, and changing items displayed in the screen image for specification setting (this feature will be referred to as a first multi-displaying construction for the convenience of description). Predetermined ones of the items displayed in the screen image for specification setting can be permitted to be displayed for addition, cancellation, and change only when a particular password is entered from the input means. Those predetermined items include, e.g., whether or not a gas blowing ejector, which is executed by only the qualified operators, is in use, whether or not cylinder control for automatic feeding of materials is made, etc. Also, predetermined ones of the items displayed in the screen image for specification setting can be always selected and displayed, but can be set to prevent cancellation or change. Those predetermined items include, e.g., the item of setting one-cycle operation wherein the pressing is performed once upon a button being depressed, and the item of setting continuous operation wherein the pressing is continuously performed while the button is being depressed, and the pressing is stopped upon the operator releasing the button.

With the above construction, since the screen image for specification setting can be displayed on the multi-displaying means, it is possible to easily perform the specification setting, visually confirm the set data, and prevent the occurrence of setting errors, etc. Further, by permitting the predetermined items to be displayed for addition, cancellation, and change only when a particular password is entered, the contents set by the qualified operators are never changed by other persons. As a result, the labor and time required for repeating the setting of those items is eliminated, the setting operation is sped up, and safety is improved. In addition, by setting the predetermined items to prevent cancellation or change, it is possible to prevent a risk from developing due to change in the intrinsic function of the press machine.

In the above first multi-displaying construction, the multi-displaying means can be a multi-displaying means for displaying at least a screen image for production, to display the number of pressed products, etc., and a screen image for preparatory planning, used to make adjustment of the vertical position of the slide, etc.; and the input means can be a sheet switch means for inputting, to the multi-displaying means, a signal for instructing one of the screen image for production and the screen image for preparatory planning to be displayed (this feature will be referred to as a second multi-displaying construction for the convenience of description).

With such a second multi-displaying construction, when the sheet switch means is operated so as to display the number of pressed products, etc., in the screen image for production on the multi-displaying means, the operator can recognize the number of pressed products, etc., at that time. Also, when the screen image for preparatory planning is displayed, the operator can smoothly perform the procedures of preparatory planning, adjustment of the vertical position of the slide, etc. Further, by providing image type displaying sections, which indicate whether the screen image is for production or is for preparatory planning, in the screen image displayed on the multi-displaying means at that time, the operator is surely kept from taking the screen image for production to be the screen image for preparatory planning, or vice versa, by mistake.

In the above second multi-displaying construction, the sheet switch means can be a portable operating means for inputting, to the multi-displaying means, a signal for instructing one of the screen image for production and the screen image for preparatory planning to be displayed (this feature will be referred to as a third multi-displaying construction for the convenience of description).

With such a third multi-displaying construction, since the portable operating means for remote control is connected to the multi-displaying means through a cable, the setting conditions can be inputted from a remote position. The portable operating means can be handled with less care, because of the lack of a fear of it being missing. Further, since the portable operating means needs no directivity, the operation disabled state and operating errors can be eliminated. In addition, as with the second multi-displaying construction, since the screen image for production or preparatory planning can be selectively displayed and the image type displaying sections are provided in the multi-displaying means, the operator is surely kept from taking the screen image for production to be the screen image for preparatory planning, or vice versa, by mistake.

Next, a fifth aspect of the press machine is featured in that the press machine includes multi-displaying means for displaying the contents of multiple actions to be executed by an operator; and the display of the multi-displaying means is controlled such that the contents of the multiple actions are erased corresponding to execution of each action, and a screen image is automatically changed to the next screen image after the contents of the multiple actions have been all executed.

With the above construction, the operator can be kept from uselessly repeating the same operation and also from taking the procedure of calling the next screen image. As a result, the setting operation can be sped up.

BRIEF DESCRIPTION OF THE DRAWINGS

FIG. 7A is a representation of an example of a screen image for a case of run preparation abnormality displayed on a liquid crystal display according to the embodiment, FIG. 7B is a representation of an example of a screen image which is displayed when an "IL" key is depressed in FIG. 7A, and FIGS. 8A, 8B and 8C are representations of examples of screen images for system setting which are displayed on the liquid crystal display according to the embodiment, the images of FIGS. 8A, 8B and 8C being displayed in the order named or vice versa.

BEST MODE FOR CARRYING OUT THE INVENTION

A preferred embodiment of a press machine according to the present invention will be described hereafter in detail with reference to the accompanying drawings.

Figure 2:
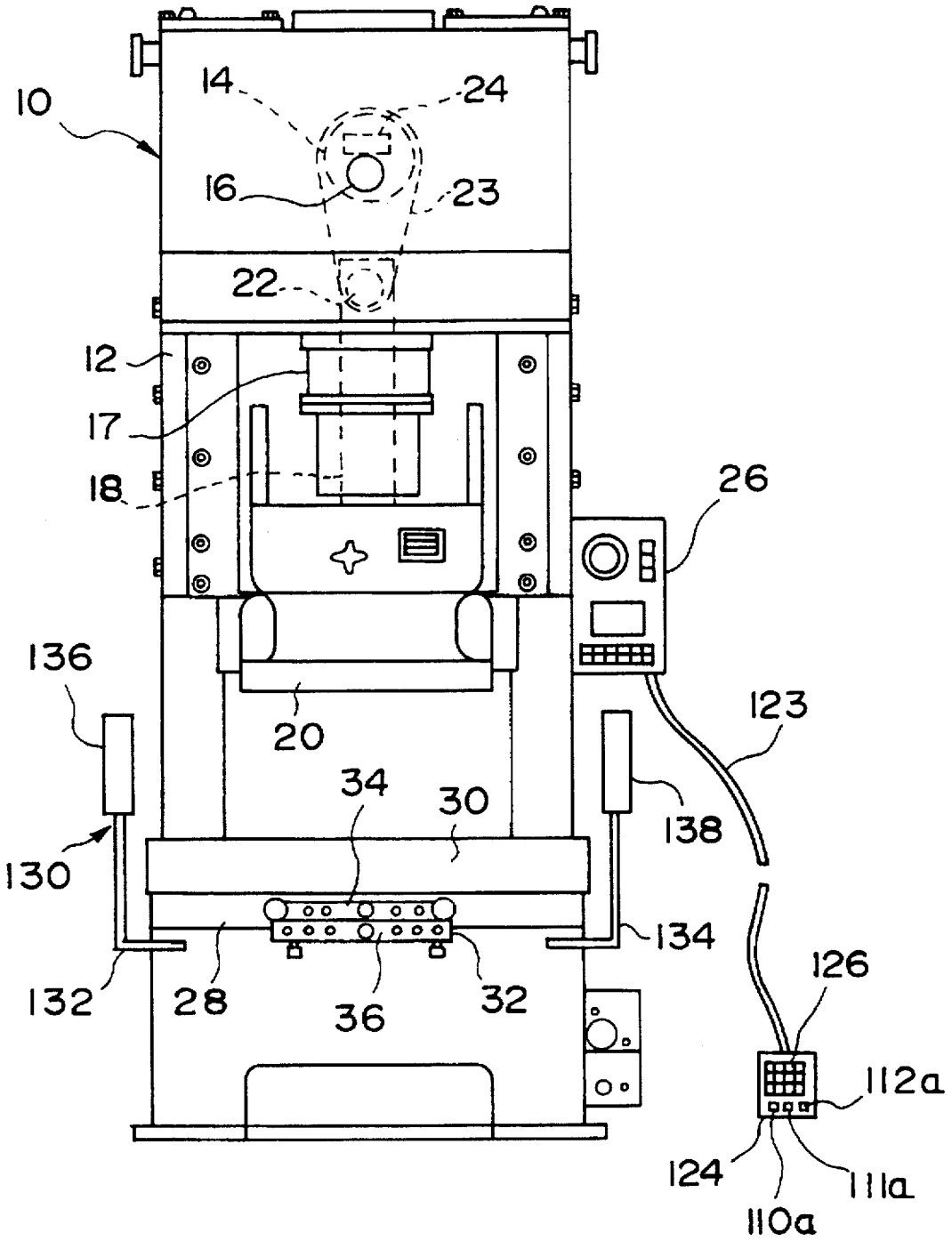
FIG. 2 is a front view of a press machine according to the embodiment.

In FIG. 2, a drive shaft 16, provided with an eccentric sleeve 14 fitted over its outer periphery, is rotatably disposed in an upper portion of a body 12 of a press machine 10. The drive shaft 16 is connected to a main motor (not shown) which serves as a drive section. When the main motor rotates forwardly or backwardly, the drive shaft 16 is rotated in the same direction. The torque of the drive shaft 16 is transmitted through a plunger 18 which moves upwardly and downwardly along a plunger guide 17 to a slide 20, which is fixed to a lower end of the plunger 18.

More specifically, the eccentric sleeve 14, rotating together with the drive shaft 16, and a wrist pin 22 provided at an upper end of the plunger 18 are connected to each other through a connecting rod 23 so that the plunger 18 is moved upwardly and downwardly via the wrist pin 22 as the connecting rod 23 moves upwardly and downwardly with the rotation of the eccentric sleeve 14. A rotary encoder 24, which serves as a rotation detecting means and a crank angle detecting means, is provided on the drive shaft 16 for detecting the rotation of the drive shaft 16. A detection signal of the rotary encoder 24 is inputted to a controller (not shown) to be used for calculating the crank angle representing the rotational position of the drive shaft 16 and the vertically moving speed of the slider 20. The crank angle or the vertically moving speed of the slider 20 thus determined is displayed on an operating section 26, which serves as a console panel, fixed to the side face of the machine body 12.

Figure 1:
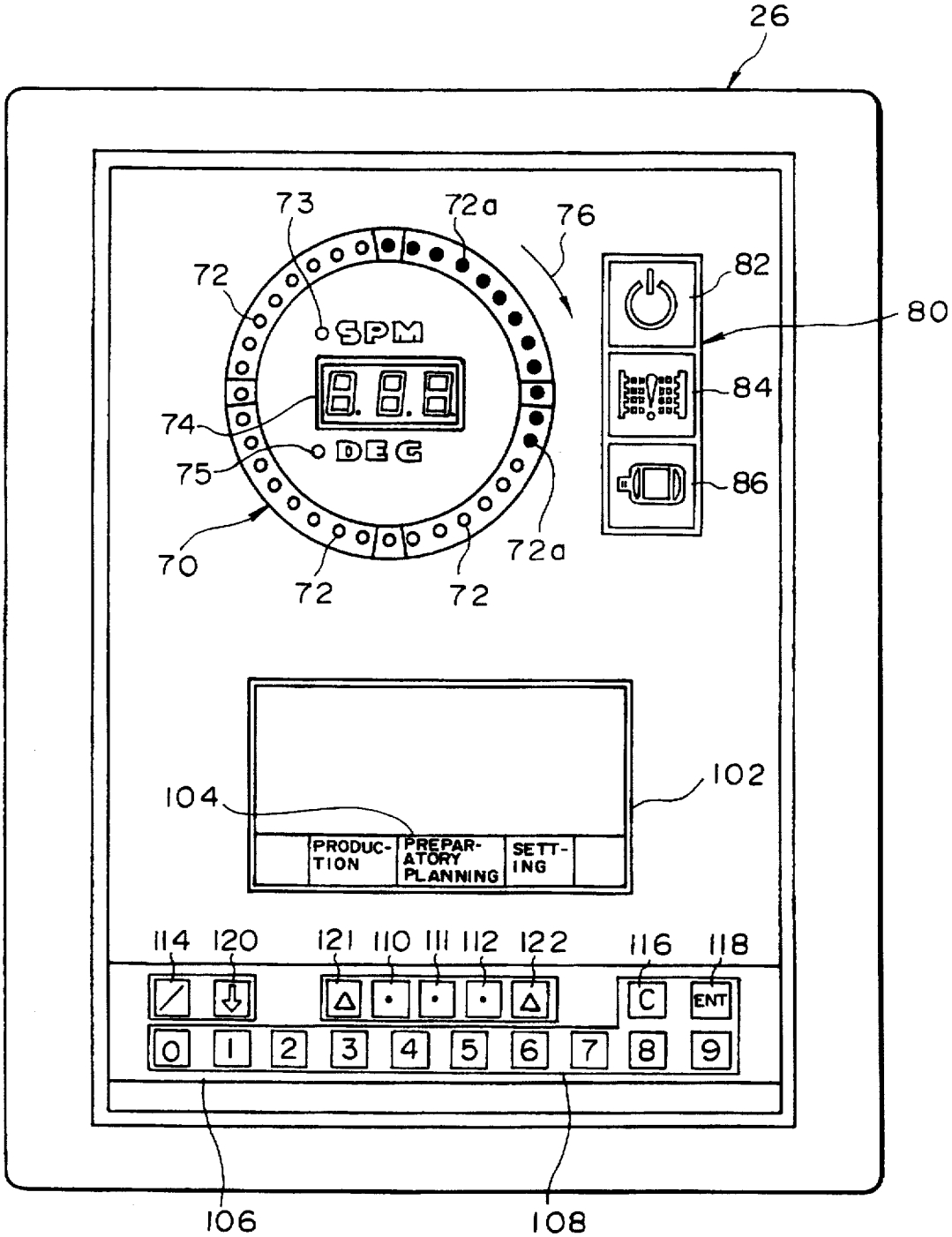
FIG. 1 is a front view of an operating section according to an embodiment of the present invention.

The operating section 26 includes, as shown in FIG. 1, a crank angle displaying section 70, which serves as a crank angle displaying means, disposed near the center in an upper area of its front face. The crank angle displaying section 70 is able to selectively display the rotational position of the drive shaft 16, i.e., the crank angle, and the vertically moving speed of the slider 20 upon switching. The crank angle displaying section 70 comprises a plurality of light emitting diodes 72, each radiating red light, for example, which are arranged into a circle, and a digital display section 74 disposed at the center, permitting the crank angle or the vertically moving speed of the slider 20 to be displayed in both analog and digital representations. When the drive shaft 16 rotates forwardly (clockwise in FIG. 1), those light emitting diodes 72*a* positioned in the range from the top dead center to the crank angle are successively turned on one by one clockwise as indicated by arrow 76 corresponding to the rotating direction of the drive shaft 16. Also, when the drive shaft 16 rotates backwardly, the light emitting diodes 72 in the crank angle displaying section 70 are successively turned on one by one in the reversed direction to the above, i.e., counterclockwise. Whether the crank angle displaying section 70 displays the crank angle or the vertically moving speed of the slider 20 can be discerned from which one of light emitting diodes 73, 75 disposed above and below the digital display section 74, respectively, is turned on.

Figure 3:
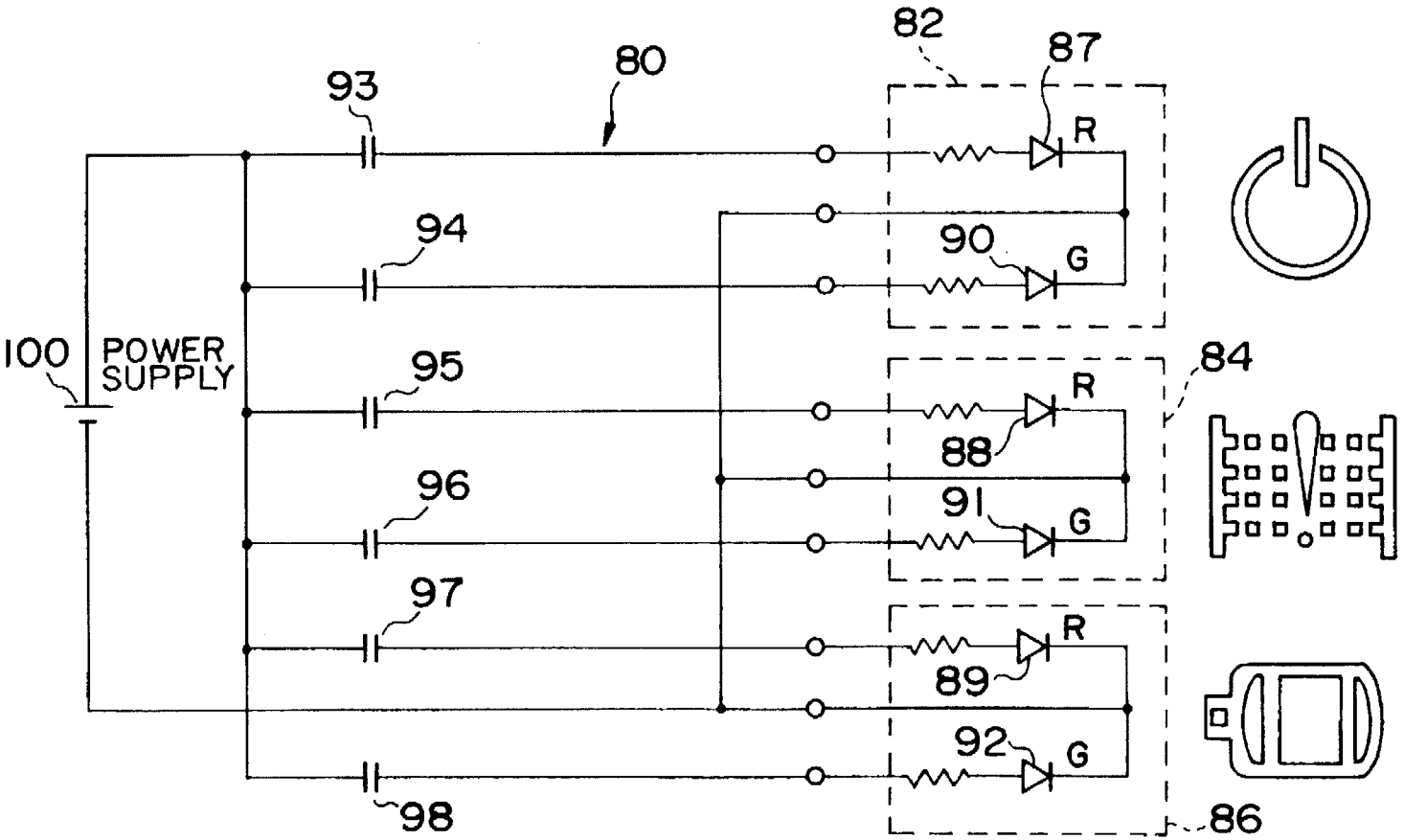
FIG. 3 is a circuit diagram of a pressing state display according to the embodiment.

Laterally of the crank angle displaying section 70, there is a pressing state display 80, which serves as a pressing state displaying means, for displaying the run state of the press. The pressing state display 80 comprises a run preparation state displaying section 82, a state-of-safety-device displaying section 84 which serves as a state-of-safety-confirming-means displaying section, and a state-of-main-motor displaying section 86, these sections each displaying the state in the form of a figure and being arranged in a vertical line from above. Each of the displaying sections 82, 84, and 86 displays the state in red, yellow or green color, depending on the run preparation state, the operating state of a safety device, and the circuit state of the main motor, respectively, which are detected by the controller. Specifically, as shown in FIG. 3, the pressing state display 80 includes light emitting diodes 87, 88, and 89 each radiating red light, and light emitting diodes 90, 91, and 92 each radiating green light, which are disposed in the displaying sections 82, 84, and 86, respectively, and these light emitting diodes are connected to a DC power supply 100 in parallel through resistors and relays 93–98.

The run preparation state displaying section 82 works such that if there occurs an abnormal run preparation state, a signal is inputted to the relay 93 and the red light emitting diode 87 is turned on, thereby informing the occurrence of abnormality. Examples of such an abnormal run preparation state include the case of an abnormality occurring in a clutch brake (not shown) for transmitting the power of the main motor to the drive shaft 16 (e.g., the case where no feedback is effected although a signal for actuating a valve to control the clutch brake is issued), the case where a run mode different from that selected by a mode selecting switch is inputted, the case where signals for rotating the main motor forwardly and backwardly are inputted at the same time, the case where the press is stopped in an emergency, etc.

Also, with regard to the run preparation state displaying section 82, if the press is held, for example, in the continuous standstill state when the controller has checked the preset items as mentioned above, signals are inputted to the relays 93 and 94 and the light emitting diodes 87 and 90 are turned on at the same time to radiate yellow light, thereby informing that the run interlock is not established. Further, when the controller has checked all the items and has found No abnormality, a signal is inputted to the delay 94 to radiate green light, thereby informing that the run preparation is completed.

The state-of-safety-device displaying section 84 works such that if a light beam of an optical detection safety device, which serves as a safety confirming means, described later, is interrupted by something, the red light emitting diode 88 is turned on, to display that the safety device has been stopped by a light interruption. Also, in the state-of-safety-device displaying section 84, when the safety device is working effectively, the light emitting diode 91 is turned on, to display that the safety device is in the effectively operating state. Further, if the safety device is brought into the ineffective state (inoperative state) by a changeover switch (not shown), the light emitting diodes 88 and 91 are turned on, to radiate yellow light, whereby the state-of-safety-device displaying section 84 displays that the safety device is ineffective.

The state-of-main-motor displaying section 86 works such that, for example, if the main motor is thermally tripped or an abnormality occurs in an inverter circuit, the light emitting diode 89 is turned on, to radiate red light, thereby informing the occurrence of an abnormality in the main motor circuit. Also, in the state-of-main-motor displaying section 86, when the main motor is rotating, both the red and green light emitting diodes 89 and 92 are turned on, to radiate yellow light, thereby giving caution against the rotation of the main motor, and when the main motor is stopped, the green light emitting diode 92 is turned on.

In the operating section 26, as shown in FIG. 1, a liquid crystal display 102, constituting a multi-displaying means, is disposed below the crank angle displaying section 70. The liquid crystal display 102 can display various messages described later, and can also selectively display any of such screen images as for production, preparatory planning, and setting, i.e., a screen image 104 for production, preparatory planning, or setting as indicated in its lower area, the image being selected by ten-numeral keys 108 in a sheet switch section 106. The screen images 104 for production, etc., also serve as image type displaying sections, one of which, corresponding to the selected screen image, is reversed in light and darkness of key-form illumination, for example, allowing the operator to easily discern what image is now displayed on the liquid crystal display 102. This surely keeps the operator from making erroneous operation.

Further, disposed below the liquid crystal display 102 is the sheet switch section 106, which serves as an input means. The sheet switch section 106 has ten-key pads 110, 111, 112 for production, preparatory planning, and setting, each of which corresponds to the screen image 104 for production, preparatory planning, or setting on the liquid crystal display 102, respectively. By operating the ten-key pads 110, 111, 112, the screen image displayed on the liquid crystal display 102 can be switched over to one corresponding to the ten-key pad operated.

The sheet switch section 106 also includes a changeover key 114, for switching over the indication of the crank angle displaying section 70 between the crank angle and the vertically moving speed of the slider 20, a clear key 116, for cancelling the setting conditions entered, and an enter key 118, through which the setting conditions, etc., are entered to the controller which serves as a control section. Further, the sheet switch section 106 includes a cursor downward moving key 120, a cursor leftward moving key 121, and a cursor rightward moving key 122, allowing the operator to optionally select any of the items indicated on the liquid crystal display 102. It is to be noted that if the displaying sections 82, 84, and 86 of the pressing state display 80 illuminate in red or yellow, the liquid crystal display 102 can display the contents of abnormality indicating why that color is illuminated, the contents of actions to deal with the abnormality, etc., as described later.

Connected to the operating section 26 is, as shown in FIG. 2, a portable console panel 124 for remote control via a cable 123. The portable console panel 124 includes a key-input section 126 constructed of, e.g., sheet switches. The operator can set the operating conditions of the press, etc., by operating the key-input section 126. The portable console panel 124 also has ten-key pads 110*a*, 111*a*, 112*a* for production, preparatory planning, and setting, each of which corresponds to the screen image 104 for production, preparatory planning, or setting on the liquid crystal display 102, respectively, as with the above ten-key pads 110, 111, 112 for production, preparatory planning, and setting.

On the other hand, a bed 28 is provided in a lower portion of the machine body 12, and a bolster 30, for fixing a lower mold in place, is fixedly provided on the bed 28. A press console panel 32, which serves as a press operating section, is disposed on the front face of the machine body 12 in its lower portion and has a plurality of control buttons arranged on its forwardly inclined upper surface 34 and its front surface 36, so that the operator can effect the manual start-up/stop operation of the press.

Figure 4:
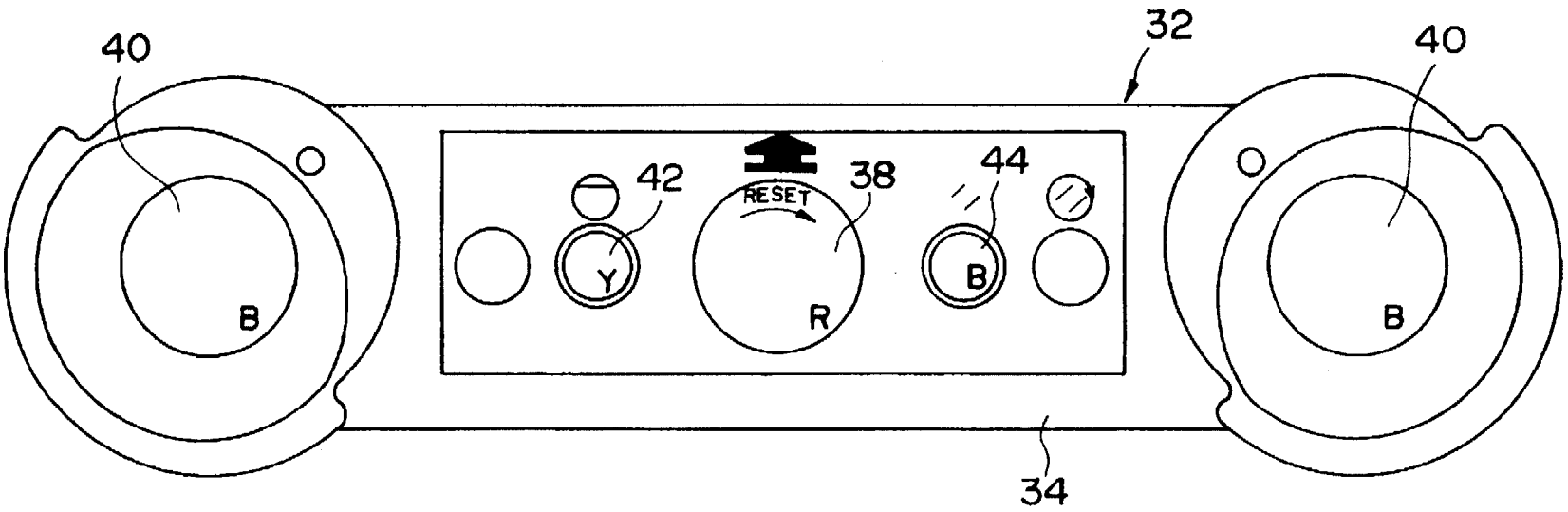
FIG. 4 is a detailed explanatory view of an upper surface of a press console panel provided on a press body according to the embodiment.

More specifically, on the upper surface 34 of the press console panel 32, as shown in FIG. 4, there are arranged an emergency stop button 38 at the center, manual control buttons 40 and 40 at both ends for effecting the manual operation, a continuous stop button 42, a sudden stop reset button 44, etc.

Figure 5:
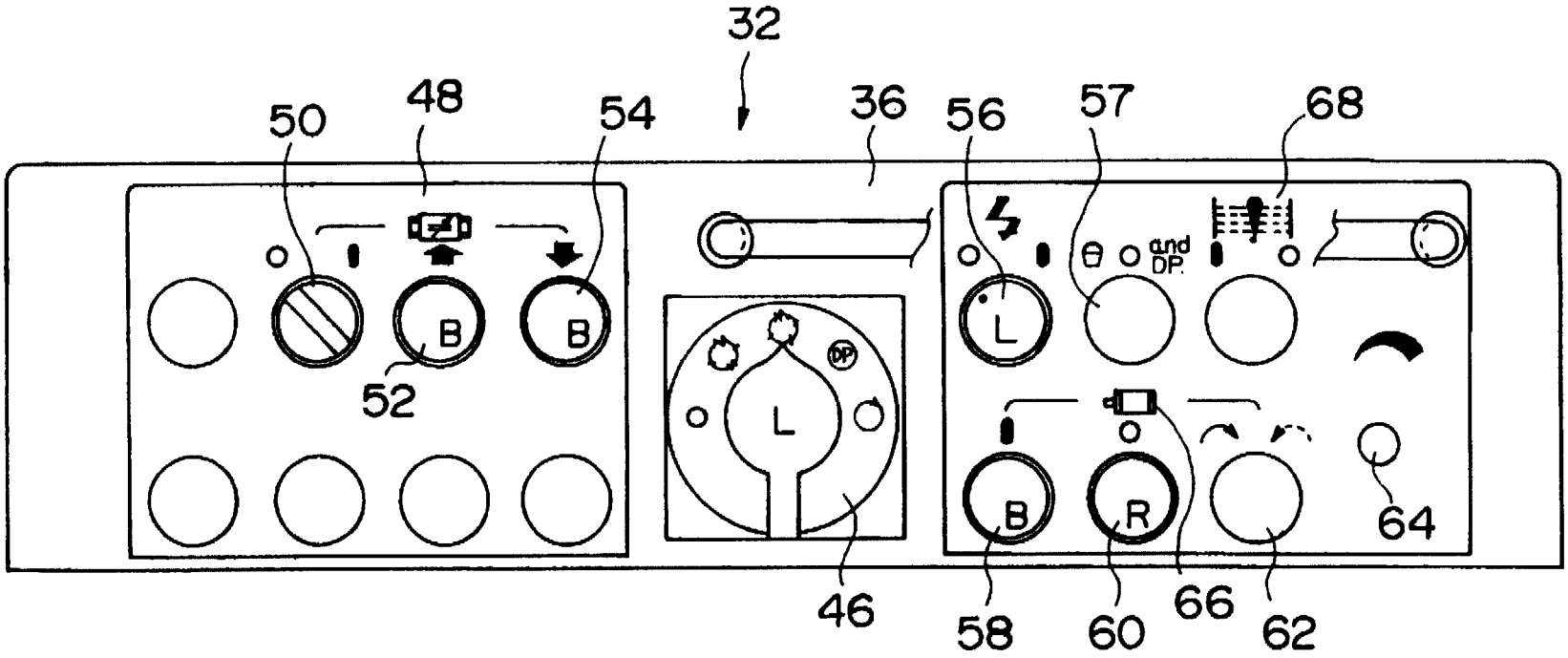
FIG. 5 is a detailed explanatory view of a front surface of the press console panel provided on the press body according to the embodiment.

On the front surface 36 of the press console panel 32, as shown in FIG. 5, there is a rotary run mode selecting switch 46, attached to the center, for selecting the run mode. A slide adjusting section 48, disposed on the left side of the run mode selecting switch 46, includes an adjustment on/off button 50, a slide up button 52, and a slide down button 54. On the right side of the run mode selecting switch 46, there are disposed a power on/off button 56, an operation switching button 57, a main motor start button 58, a main motor stop button 60, a main motor forward/backward rotation selecting button 62, a speed setting amount knob 64, a state-of-motor displaying lamp 66 for informing the operator of whether or not the main motor is operating normally, and a state-of-safety-device displaying lamp 68 for informing whether the safety device which serves as a safety confirming means is effective or ineffective.

A safety device 130 is disposed in front of the machine body 12 so as to be positioned laterally from both sides (see FIG. 2). The safety device 130 mainly comprises a light emitting portion 136 and a light receiving portion 138, attached to the machine body 12 through brackets 132 and 134, respectively; these portions 136 and 138 being arranged to face each other. If the operator's hand or the like is inserted between the light emitting portion 136 and the light receiving portion 138, a light beam emitted from the light emitting portion 136 is interrupted, whereupon the main motor of the press is stopped and the state-of-safety-device displaying section 84 of the pressing state display 80 illuminates in red.

Figure 6:
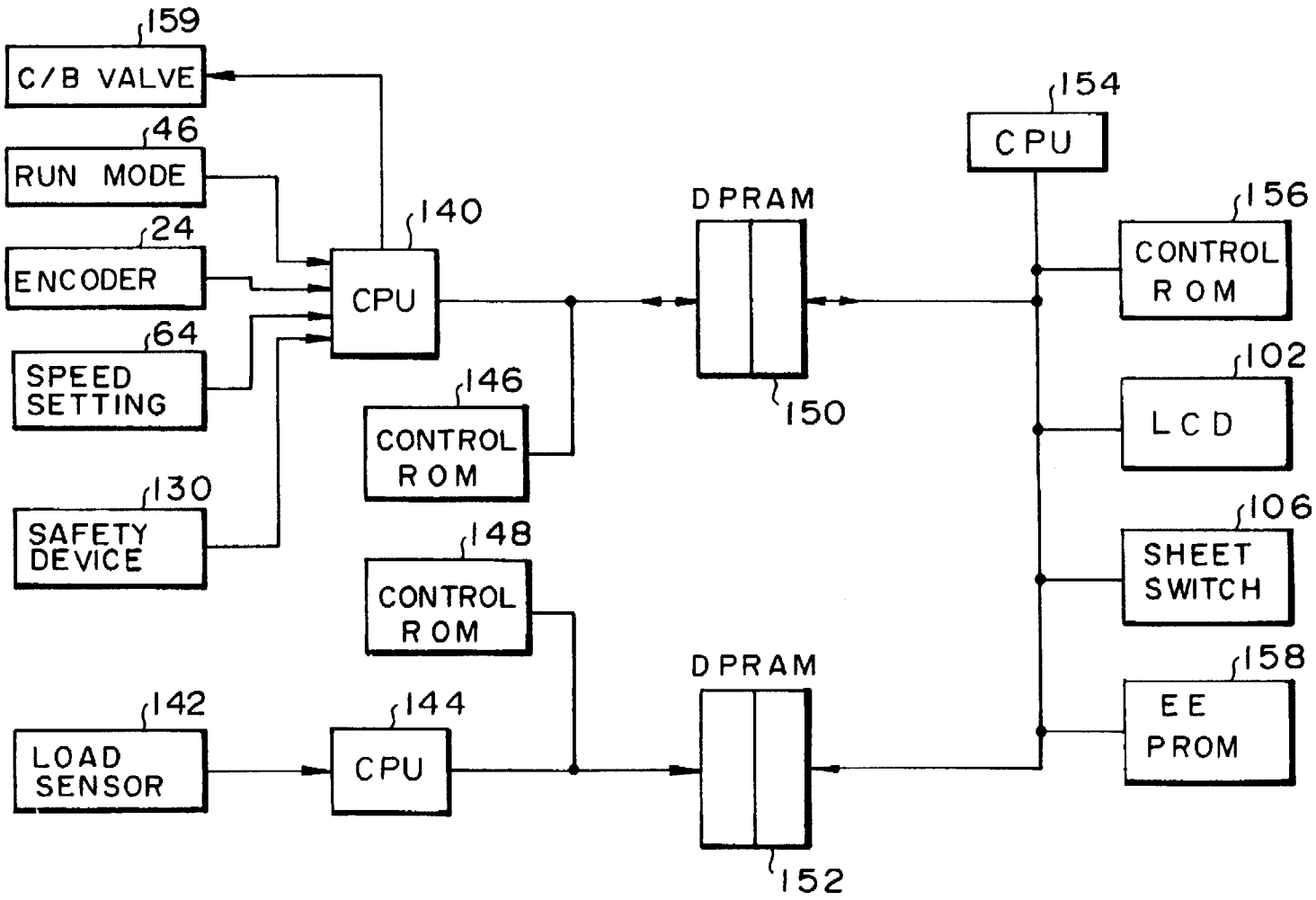
FIG. 6 is a block diagram of a controller according to the embodiment.

The controller, which serves as a control section of the press, comprises, as shown in FIG. 6, a CPU 140 to which are inputted control signals from the various buttons and the mode selecting switch 46 on the press console panel 32, etc., and a CPU 144 to which is inputted a detection signal of a load sensor 142, e.g., a load cell, for detecting the load of the slide 20. Connected to the CPUs 140 and 144 are control ROMs 146 and 148, in which control programs, etc., are stored, and DPRAMs 150 and 152, into which various pieces of data and information are written, through respective buses. Also, the DPRAMs 150 and 152 are connected through a bus to a CPU 154 for controlling the console panel 26.

While each of the CPU 140, the control ROM 146, and the DPRAM 150 is illustrated as being a single unit in FIG. 6, each of these parts can be provided in duplicate to make up a duplicate safety circuit. In this case, for example, the lead from one encoder 24 is branched and connected to the two CPUs 140, and a C/B valve 159 is connected to each of the CPUs 140. Additionally, it is also possible to interconnect the two CPUs 140 or connect the two DPRAMs 150 to respective CPUs 154 to make up duplex circuits, for the purpose of improving safety.

In accordance with the program stored in a control ROM 156, the CPU 154 receives various pieces of data and information from the CPUs 140 and 144 through the DPRAMs 150 and 152 and display them on the liquid crystal display (LCD) 102. Also, connected to the CPU 154 is an EEPROM (or RAM) 158, into which setting values, etc., are temporarily written, through a bus. Additionally, the CPU 140 outputs a control signal to the C/B valve 159 for making clutch/brake switchover control.

The operation of this embodiment thus constructed will be described below. When the main motor is driven to rotate the drive shaft 16, a detection signal of the rotary encoder 24 is inputted to the CPU 140 of the controller. The CPU 140 calculates the crank angle of the drive shaft 16 (the eccentric sleeve 14) and the vertically moving speed of the slider 20 in accordance with the program in the control ROM 146, and then sends the calculated results to the CPU 154 through the DPRAM 150. The CPU 154 turns on the light emitting diode 73 or 75 in the crank angle displaying section 70. Specifically, depending on the state of the changeover switch 114 in the sheet switch section 106, the CPU 154 turns on one of the light emitting diodes 73 and 75 to clearly indicate whether the crank angle or the vertically moving speed of the slider 20 is displayed. Then, the CPU 154 turns on successive ones of the light emitting diodes 72 in the crank angle displaying section 70 whose number corresponds to the crank angle corresponding to the vertically moving speed of the slider 20, and also indicates the crank angle or the vertically moving speed of the slider 20 on the digital display section 74 in digital representation. In this embodiment, therefore, the operator can easily recognize in which direction and how far the drive shaft 16 is being rotated, and how fast the vertically moving speed of the slider 20 is, and can easily set or adjust the operating conditions, etc.

When any of the run modes, such as automatic operation, manual operation, and continuous one cycle, is selected by operating the run mode selecting switch 46 on the press condole panel 32, or when the pressing speed is set or changed by turning the speed setting volume knob 64, this information is sent to the CPU 154 through the CPU 140 and is displayed on the liquid crystal display 102, which serves as a multi-displaying means. Accordingly, the set run mode and other data can be visually confirmed by the operator with ease, the occurrence of erroneous setting can be avoided, and abnormality in setting, etc., can be easily detected. As a result, it is possible to considerably improve safety and operability in the pressing operation.

Further, in this embodiment, since the press operating state is displayed on the pressing state display 80 of the console panel 26 in the form of a figure and in any of three different colors, i.e., red, yellow and green, depending on the state, the operator can easily recognize the occurrence of an abnormality, a not-yet-completion of the press preparation, etc., and hence can take necessary actions promptly and can be protected from a possible risk. In addition, if an abnormality occurs in the pressing state, the contents of the abnormality is displayed on the liquid crystal display 102. Therefore, the operator can promptly grasp what abnormality has occurred.

For example, if the run preparation state displaying section 82 illuminates in red or yellow when the screen image for production is displayed on the liquid crystal display 102, the abnormality which has occurred is displayed in an upper area of the display screen image as shown in FIG. 7A. Then, if an IL key is depressed, a screen image including, e.g., messages indicating actions to be taken to deal with the occurrence of the abnormality, as shown in FIG. 7B. Further, if "2" in a lower area of the screen image of FIG. 7B or one "2" of the ten-numeral keys in the sheet switch section 106 is depressed, another screen image including further messages is displayed.

Further, in this embodiment, by operating the key-input section 126 of the portable console panel 124 connected to the operating section 26 through the cable 123, screen images for system setting, as shown in FIGS. 8A to 8C, can be displayed on the liquid crystal display 102, and the certain operating conditions can also be set in the same manner as operating the sheet switch section 106 of the operating section 26. Accordingly, the press can be operated with remote control, and the operating conditions, etc., can be inputted to the operating section 26 through the cable 123. It is hence possible to eliminate entry errors and ensure safe operation free from anxiety. In addition, the portable console panel 124 is surely prevented from being missing and can be handled with less care.

For example, when the ten-key pad 112*a*, for setting in the key-input section 126 of the portable console panel 124, is operated, the screen image of system setting selection (FIG. 8A), i.e., "1 Specification Circuit Initialization", appears. Then, when the key-input section 126 is depressed, the items to be set relating to various conditions for "Specification Circuit Initialization 1", e.g., "1 C/B Air Pressure", "2 Slide Adjustment", "3 Main M Circuit" and so on, are displayed in the next screen image (FIG. 8B). When the air pressure of "1 C/B Air Pressure" is set, the display area for entry moves to the next number, i.e., "2 Slide Adjustment", enclosed by a rectangular box, allowing the operator to recognize the item to be set next.

The characters enclosed by a rectangular box can be displayed for easier discernment in such a manner that the entirety of the characters are displayed in a green box, or the characters themselves are displayed in a different color. When the setting is completed by setting all of the items, one after another, the items to be set relating to "Specification Circuit Initialization 2 (Option)" appear as shown in FIG. 8C. These items are also displayed in a like manner for easier discernment. Since the items to be set are displayed and can be set even from a remote position, the setting operation is facilitated. Particularly, this advantage is notable in large-sized press machines because a console panel of such a press machine is often positioned at a distance from the operator.

In the process of specification setting, etc., when the operator sets or executes the item displayed on the liquid crystal display 102, the CPU 154 erases the executed item. Then, when all of the displayed items are executed, the CPU 154 automatically changes the screen image and displays the next screen image. Accordingly, the operator can be kept from making the same setting twice by mistake and also from taking the procedure of calling the next screen image. As a result, the setting operation can be sped up.

Of the items in the screen image for specification setting displayed on the liquid crystal display 102, the predetermined items can be permitted to be displayed for addition, cancellation and change only when a particular password is key-inputted from the sheet switch section 106 or the portable console panel 124. With this feature, the labor and time necessary for the qualified operators to repeat the setting of those items for each initialization is eliminated, and operability is improved. In addition, since other operators are kept from changing the setting of those items, safety is also improved. The above predetermined items include, e.g., whether or not a gas blowing ejector, which is executed by only the qualified operators, is used, whether or not cylinder control for automatic feeding of materials is made, etc.

Furthermore, of the items in the screen image for specification setting displayed on the liquid crystal display 102, the predetermined items, e.g., the item of setting one-cycle operation wherein the pressing is performed once upon the manual button 40 being depressed, and the item of setting continuous one-cycle operation wherein the pressing is continuously performed while the manual button 40 is being depressed, and the pressing is stopped upon the operator releasing the manual button 40, can be always selected and displayed. However, by setting those items to be unable to cancel and change, it is possible to prevent troubles, etc., from developing by the occurrence of an unexpected accident due to, e.g., change in the intrinsic function of the press.

While the foregoing embodiment has been described as arranging the plurality of light emitting diodes 72 in the crank angle displaying section 70 and turning on part of the light emitting diodes 72 along a line to indicate the crank angle, etc., those light emitting diodes can be turned on to illuminate in the form of a continuous belt. Also, while the foregoing embodiment has been described as illuminating the pressing state display 80 in three colors, the display can be illuminated in four or more colors. Further, while the foregoing embodiment has been described in connection with the press having the eccentric sleeve 14, the present invention is also applicable to, for example, a press having a crankshaft.

INDUSTRIAL APPLICABILITY

The present invention is advantageously practiced as a press machine whose set operating conditions, pressing state, etc., can be easily grasped and whose safety and operability in the pressing operation can be improved.

We claim:

1. A press machine comprising:

a slide;

a drive section for moving said slide vertically;

safety confirming means for detecting that an operator has entered an operating region of said slide beyond a predetermined boundary, and for stopping the movement of said slide by said drive section in response to said safety confirming means detecting that an operator has entered said operating region of said slide beyond said predetermined boundary;

pressing state displaying means for displaying a press operating state, said pressing state displaying means comprising:

a run preparation state displaying section for displaying a press preparation state in the form of a figure, and a state-of-safety-confirming-means displaying section for displaying an operating state of said safety confirming means in the form of a figure.

2. A press machine in accordance with claim 1, wherein said run preparation state displaying section displays its states in different colors which change depending on the press preparation state, and wherein said state-of-safety-confirming-means displaying section displays its states in different colors which change depending on the operating state of said safety confirming means.

3. A press machine in accordance with claim 2, wherein a multi-displaying means is disposed near said pressing state displaying means, and wherein said multi-displaying means displays at least one of (a) a state corresponding to a display color and (b) contents of actions to be taken by an operator corresponding to the state represented by the display color.

4. A press machine comprising:

a slide;

a drive section for moving said slide vertically;

a drive shaft for transmitting power from said drive section to said slide;

a control section for controlling operations of said press machine;

means for inputting control information to said control section;

a multi-displaying means for selectively displaying, as a screen image for specification setting:

(a) control information inputted to said control section, and (b) system setting information; and input means for adding, cancelling, and/or changing items displayed in said screen image for specification setting.

5. A press machine in accordance with claim 4, wherein the control information inputted to said control section includes a vertically moving speed of said slide, and wherein said control section controls a vertically moving speed of said slide.

6. A press machine in accordance with claim 5, wherein the system setting information includes specification circuit initialization, clutch brake control system constant, and clutch brake standby point stop adjustment.

7. A press machine in accordance with claim 4, wherein predetermined ones of items displayed in said screen image for specification setting can always be selected and displayed, but cannot be readily cancelled or changed.

8. A press machine in accordance with claim 4, wherein predetermined ones of items displayed in said screen image for specification setting are permitted to be displayed for addition, cancellation, or change only when an authorized password is entered via said input means.

9. A press machine in accordance with claim 8, wherein predetermined ones of items displayed in said screen image for specification setting can always be selected and displayed, but cannot be cancelled or changed except with an authorized password.

10. A press machine in accordance with claim 4, wherein said multi-displaying means is a multi-displaying means for displaying:

(a) a screen image for production information, and (b) a screen image for preparatory planning; and wherein said input means is a sheet switch means for inputting to said multi-displaying means a signal for instructing one of said screen image for production information and said screen image for preparatory planning to be displayed.

11. A press machine in accordance with claim 10, wherein said screen image for preparatory planning enables adjustment of the vertical position of said slide.

12. A press machine in accordance with claim 10, wherein said sheet switch means is a portable operating means for inputting to said multi-displaying means a signal for instructing one of said screen image for production information and said screen image for preparatory planning to be displayed.

13. A press machine in accordance with claim 4, wherein said multi-displaying means is a multi-displaying means for displaying contents of multiple actions to be executed by an operator, and said multi-displaying means erases a display of an action as its performance is completed and changes to a different screen image when all of said multiple actions have been executed.

14. A press machine in accordance with claim 4, wherein said multi-displaying means is a multi-displaying means for displaying at least one of (a) a state corresponding to a display color and (b) contents of actions to be taken by an operator corresponding to the state represented by the display color.

* * * * *